US006948426B2

(12) United States Patent
Rush

(10) Patent No.: US 6,948,426 B2
(45) Date of Patent: Sep. 27, 2005

(54) SCREEN PRINTING METHOD FOR A FLAT TEXTILE STRUCTURE AND DEVICE FOR CARRYING OUT THE METHOD

(75) Inventor: John Rush, Frick (CH)

(73) Assignee: Textilma AG (CH)

( * ) Notice: Subject to any disclaimer, the term of this patent is extended or adjusted under 35 U.S.C. 154(b) by 0 days.

(21) Appl. No.: 10/491,394

(22) PCT Filed: Sep. 23, 2002

(86) PCT No.: PCT/CH02/00526

§ 371 (c)(1),
(2), (4) Date: Mar. 31, 2004

(87) PCT Pub. No.: WO03/031183

PCT Pub. Date: Apr. 17, 2003

(65) Prior Publication Data

US 2004/0237812 A1 Dec. 2, 2004

(51) Int. Cl.[7] ..... B41M 1/12
(52) U.S. Cl. ..... 101/129; 101/118; 101/485
(58) Field of Search ..... 101/114, 115, 101/116, 118, 119, 120, 129, 485

(56) References Cited

U.S. PATENT DOCUMENTS 5,036,759 A * 8/1991 Olmedo et al. ..... 101/114
5,255,598 A * 10/1993 van Sas et al. ..... 101/118
6,129,013 A * 10/2000 Takasawa et al. ..... 101/114

* cited by examiner

*Primary Examiner*—Ren Yan
(74) *Attorney, Agent, or Firm*—George Pappas

(57) ABSTRACT

The invention relates to a rotation screen printing method for flat textile structures, especially textile strips (1). According to said method, at least one image which is represented as a pattern repeat is printed on the flat structure (1) by means of a continuously rotating printing cylinder (2) having at least one circumferential section in the lateral surface, which is permeable to printing medium. In order to print a pattern repeat in the circumferential direction, a flat textile structure (1) is moved into a printing position determined by the printing cylinder, is brought into active communication with the printing cylinder (2) and is taken out of communication after the printing. To this end, the flat textile structure (1) is moved back and forth, in steps, for each pattern repeat. A device for carrying out said method comprises a transport unit (4) having a reversible drive device (11) for displacing the flat structure by means of a step-by-step and back and forth movement.

16 Claims, 7 Drawing Sheets

SCREEN PRINTING METHOD FOR A FLAT TEXTILE STRUCTURE AND DEVICE FOR CARRYING OUT THE METHOD

TECHNICAL FIELD

The invention relates to a screen printing method for flat textile structures and to a device for carrying out the method.

BACKGROUND

The screen printing method is sufficiently well known. Using the screen printing method, different flat materials, for example paper, plastic, fabrics and the like, are printed. For screen printing, use is made of a printing cylinder which comprises a cylindrical screen or perforated cylinder with ink-permeable openings in the entire circumferential surface or in some regions of the circumferential surface and of a squeegee which is arranged within the screen.

A printing cylinder of this type is disclosed in W0 9605058. FIG. 1 discloses a printing cylinder of this type in a printer arrangement having a pressure roll by means of which the flat structure to be printed is brought into contact with the screen. In this printer arrangement, the printing cylinder rotates continuously in the direction of the arrow X and the surface structure is moved in the direction of the arrow Y at the same linear speed as the circumferential speed of the screen. Using this arrangement, the flat structure is printed continuously with the same pattern formed on the screen cylinder. It is seen as disadvantageous that in each case a new printing cylinder has to be provided for the patterns to be printed. This results in greater expenditure in production and also in stockkeeping.

When printing flat textile structures, printing is carried out with printing repeats, each printing repeat corresponding to one image. It is possible for identical or different images to be printed at a distance from one another. In order to print an individual image, a section which is permeable to the printing medium and which is shorter than the length of the screen circumference, and a section which is impermeable to the printing medium are arranged on the printing cylinder. In a manner analogous to this, a printing cylinder with different images has a corresponding number of sections permeable to the printing medium and sections impermeable to the printing medium. In this mode, images are printed continuously at a distance onto the surface structure. As is known, this mode is used for printing labels.

During the printing of images with a printing cylinder, deficiencies can occur in the print and in the print quality, which leads to waste and consequently to a low production output.

SUMMARY OF THE INVENTION

The invention is based on the object of improving a screen printing method and a device for carrying out the method.

The invention is based on the idea that, in order to print a printing repeat, the flat textile structure is brought into operative connection with the printing cylinder at a printing position predetermined by the printing cylinder and, after the printing repeat has been printed, is brought out of operative connection, and the printing of the flat structure is controlled by means of a stepwise forward and back movement of the flat structure.

The invention advantageously provides the possibility of setting the flat structure individually to the printing position predetermined by the printing cylinder. As a result, the distance between the images on the flat structure can be determined or changed. The flat structure can also be pulled to the printing position or beyond the printing position and the image can be printed again. This improves the print quality.

The invention further provides for it to be possible to use a stencil for printing. Using the stencil is essentially associated with the following advantages. Different images can be printed with the same cylinder. As a result of the replaceability of the stencil, the downtime can be shortened. The openings of the stencil can be produced online in the device by means of a thermal device or a laser device. These advantages lead to higher productivity and to extensive automation of the production.

BRIEF DESCRIPTION OF THE DRAWINGS

Exemplary embodiments of the invention will be explained below using the drawings, in which.

DESCRIPTION OF THE PREFERRED EMBODIMENTS

Figure 1:
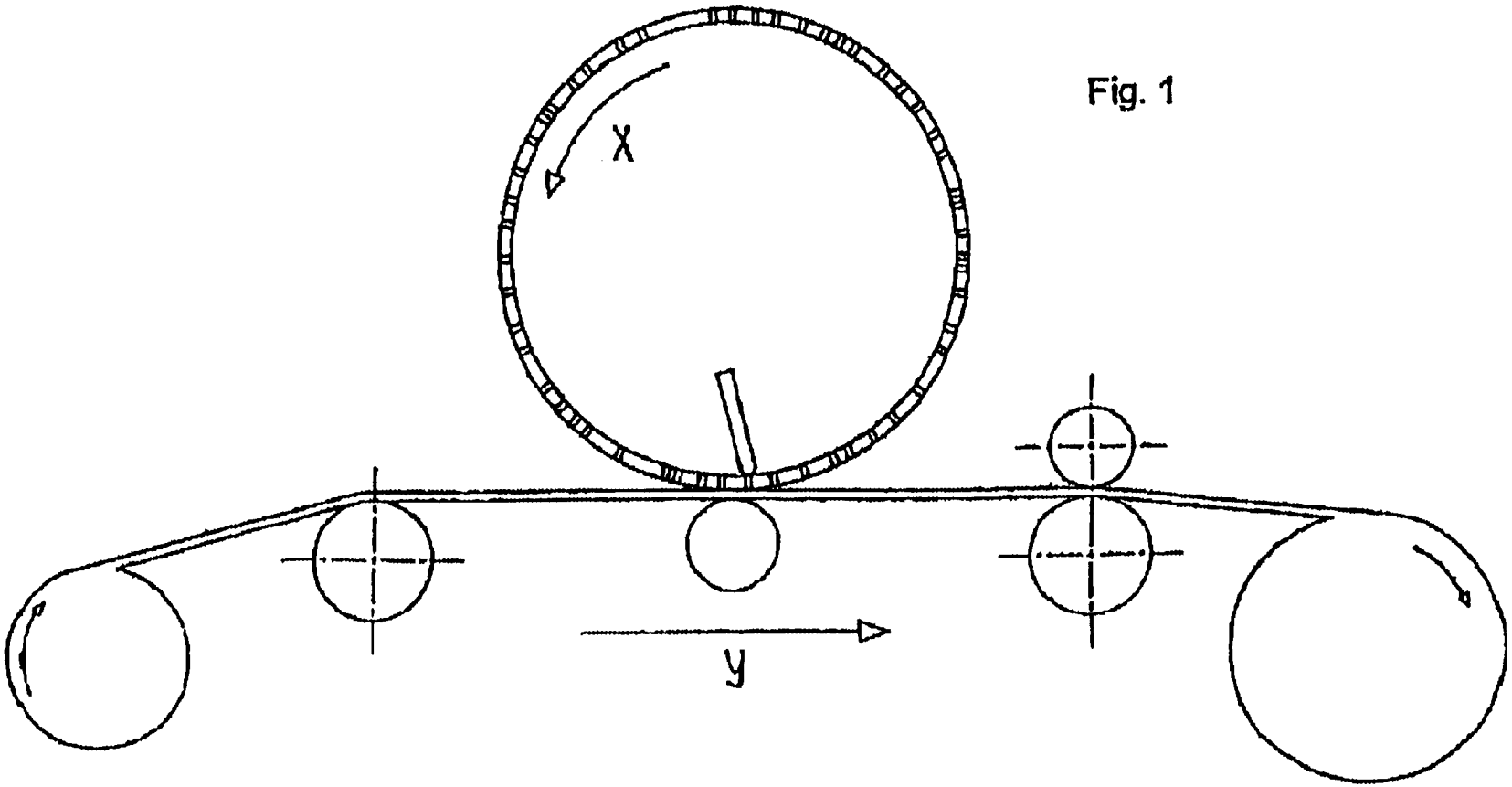
FIG. 1 shows a known design of a screen printing device.
Figure 2:
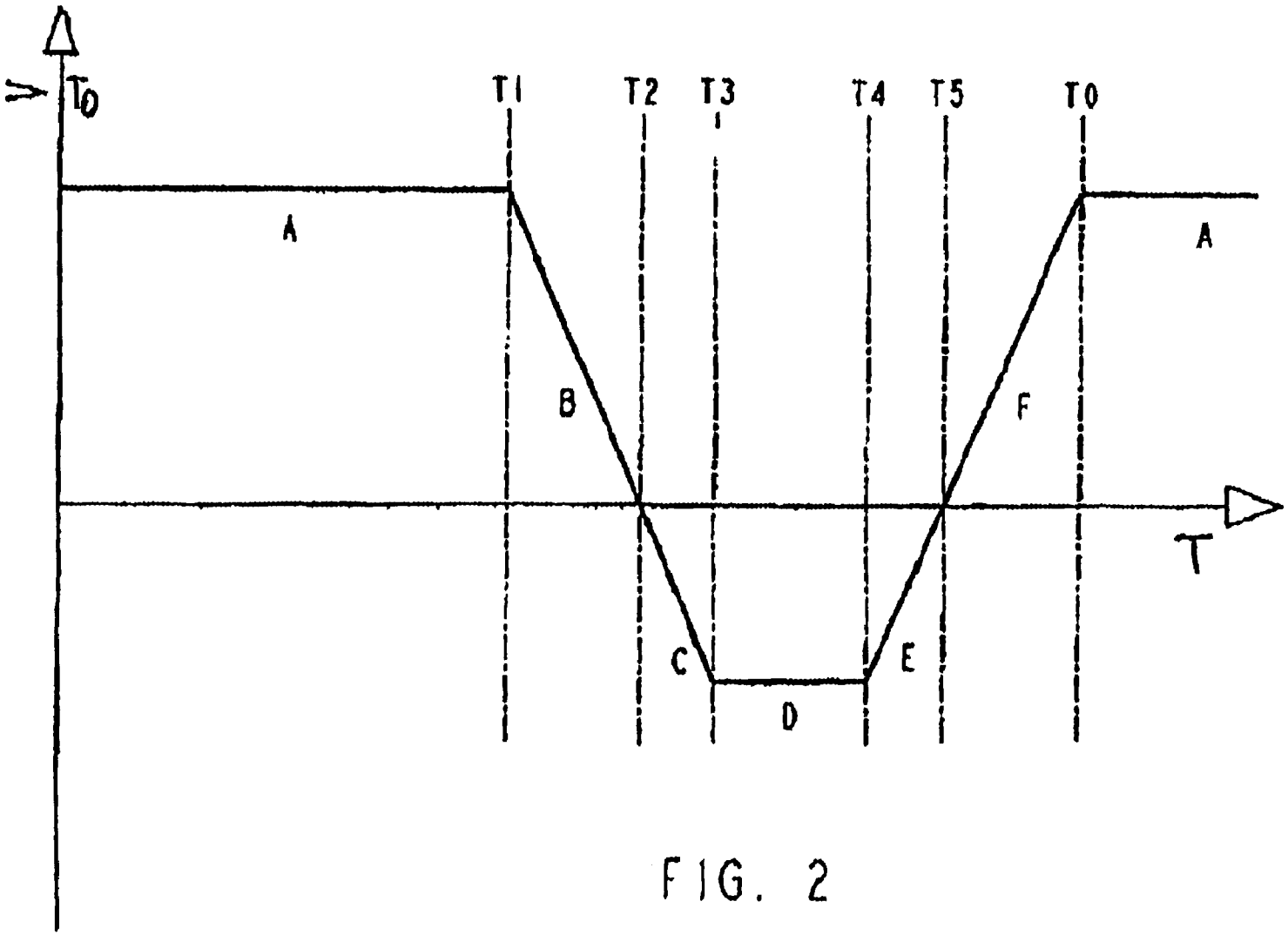
FIG. 2 shows a speed/time graph of a flat structure moved in accordance with the method of the invention.

The following description is based on printing textile strips. Reference is made to FIG. 2, which represents the sequence when printing a printing repeat. At the time T0, the textile strip is moved forward over the time interval A at a conveying speed synchronized with the circumferential speed V of the printing cylinder and is in contact with the press surrender, so that it is printed. The printing operation is completed shortly before the time T1 is reached. From the time T1 on, the textile strip is braked with a constant braking force during the time interval B, so that the conveying speed decreases linearly and reaches a standstill at the time T2. From the time T2 on, the textile strip is moved rearward. At the time T2 the textile strip is accelerated during the time interval C and, at the time T3, reaches a constant conveying speed, which is maintained during the time interval D until the time T4. From the time T4 on, the textile strip is braked during the time interval E until the time T5. From the time T5 on, the textile strip is again moved forward, the textile strip being accelerated to the conveying speed synchronized with the circumferential speed of the pressure cylinder during the time interval F until the time T0. At the time T0 a new printing interval begins during the time interval A, that is to say the sequence is repeated.

Figure 3A:
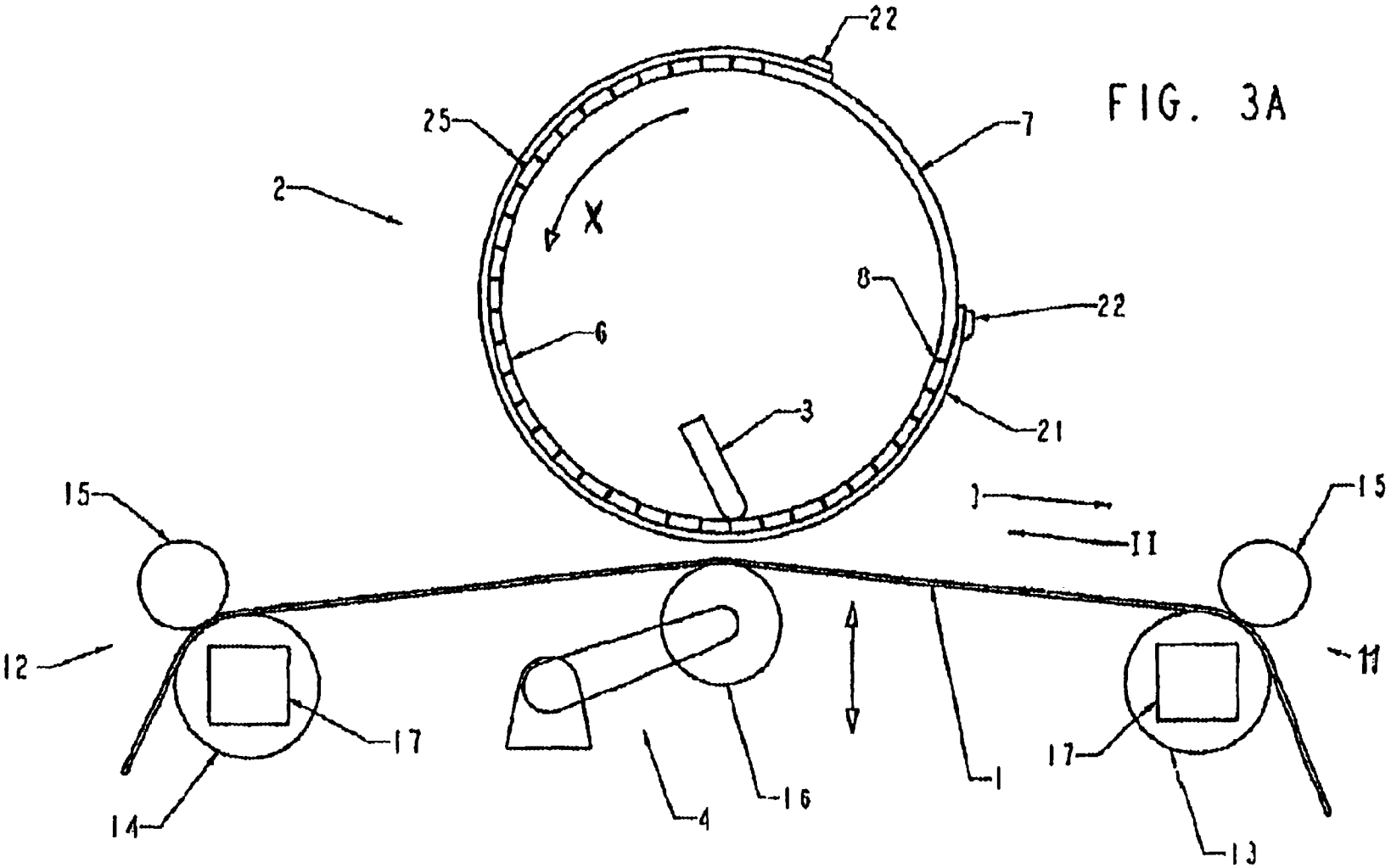
FIG. 3A shows a view of a printout device according to the invention for carrying out the method.

As FIG. 3A shows, a device for printing a textile strip 1 comprises a printing cylinder 2, a squeegee 3 arranged in the printing cylinder 2 for inking the printing cylinder, and a conveying device 4 for the textile strip. The printing cylinder 1 is formed as a hollow cylinder and has a wall section 6 that is permeable to a printing medium and a section 7 that is impermeable to the printing medium. The printing cylinder 2 can consist of a suitable material, for example of metal, plastic or the like. The squeegee 3 is arranged to be stationary in the printing cylinder 2. The conveying device 4 is formed as a roller arrangement and comprises two pairs of rollers 11 and 12 each having a transport roller 13 and 14 for conveying the textile strip 1, a pressure roller 15 for pressing the textile strip 1 against the transport roller and also a pressure roller 16 for pressing the textile strip 1 against the printing cylinder 2. The conveying device 4 has a driving device with two reversible drive motors 17, which are coupled to the transport rollers 13 and 14 in order to move the textile strip 1 forward in the direction of arrow I and rearward in the direction of arrow II. The drive motor used is a stepping motor or a servo motor. The pressure roller 16 is freely rotatably arranged and is mounted in means, not illustrated, in order to lift the pressure roller off the printing cylinder or to press it onto the printing cylinder.

Arranged on the circumference of the printing cylinder 2 is a printing stencil 21. The printing cylinder is provided with means 22 for clamping the printing stencil firmly, so that the printing stencil 21 can be fixed to the printing cylinder 2 and replaced manually.

Figure 3B:
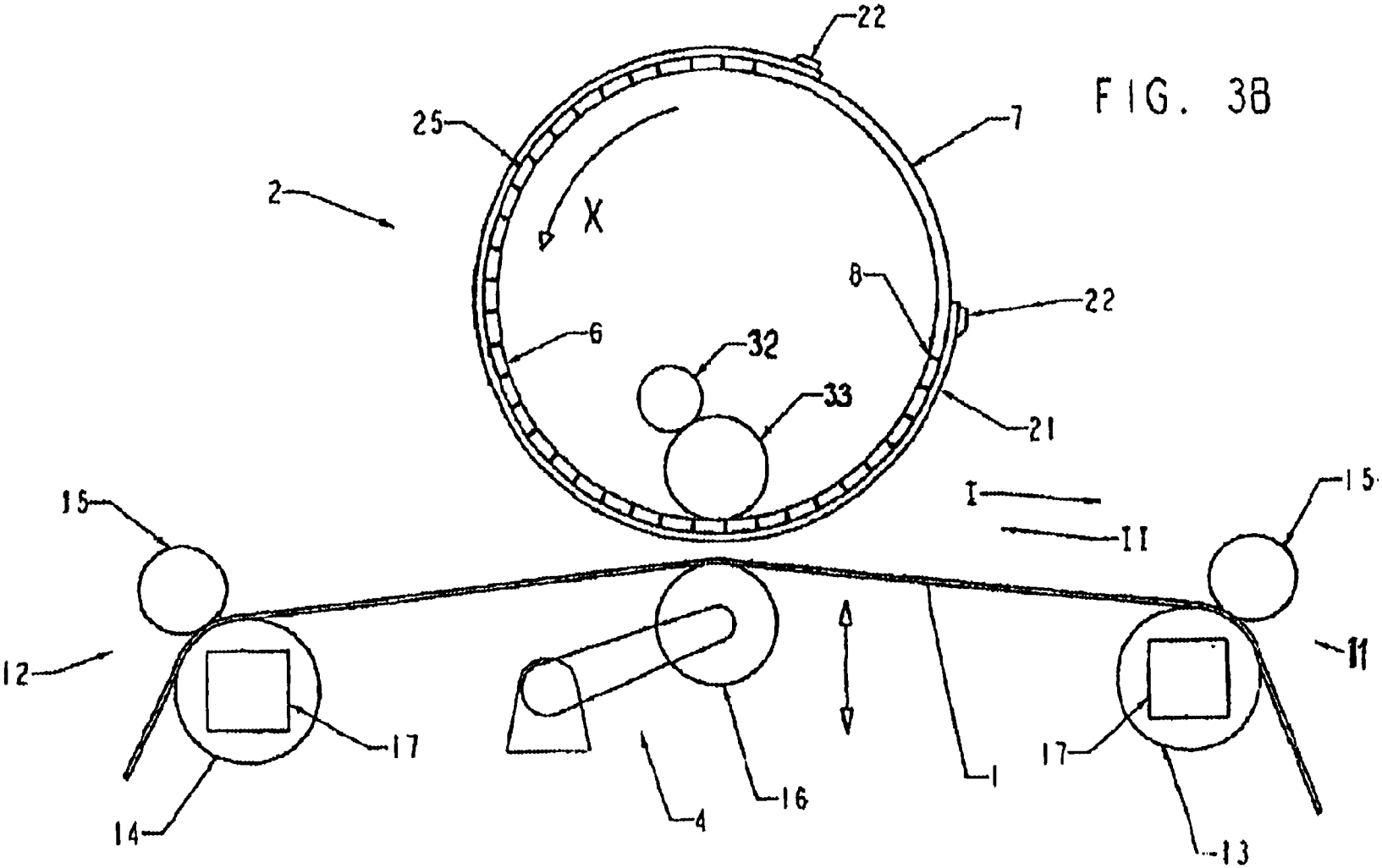
FIG. 3B shows a view of a modified design of the device according to FIG. 3A.

The device according to FIG. 3B differs from the device according to FIG. 3A in that two inking rolls 32 and 33 for inking the printing cylinder 2 are provided.

Figure 4:
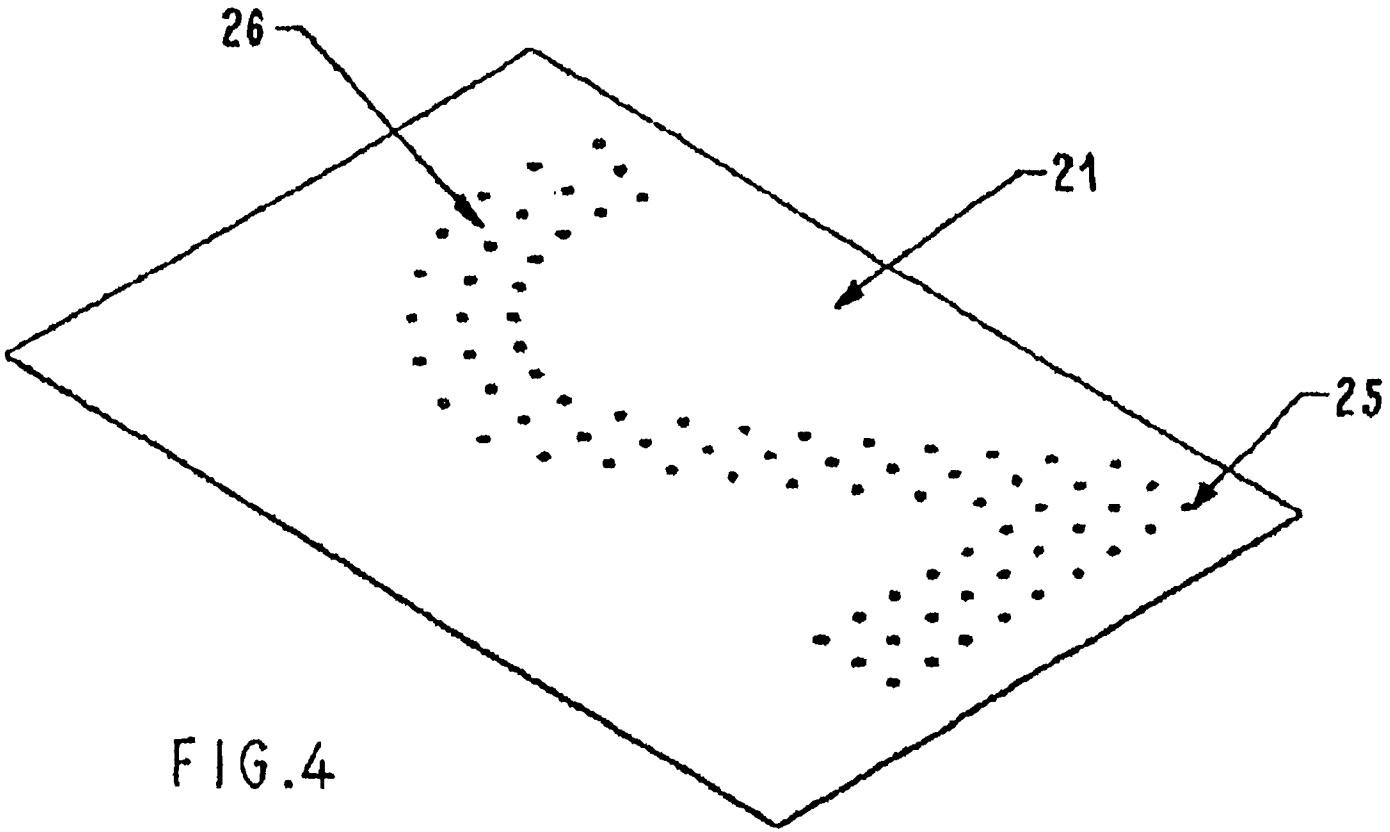
FIG. 4 shows a view of a printing stencil.

FIG. 4 shows an example of a printing stencil. The printing stencil 21 consists of material which is impermeable to the printing medium and is provided with through-holes 25 for the printing medium which represent a pattern 26 to be printed. The printing stencil 21 can consist of plastic in such a way that the through holes can be produced by means of a thermal printhead or a laser device.

Figure 5:
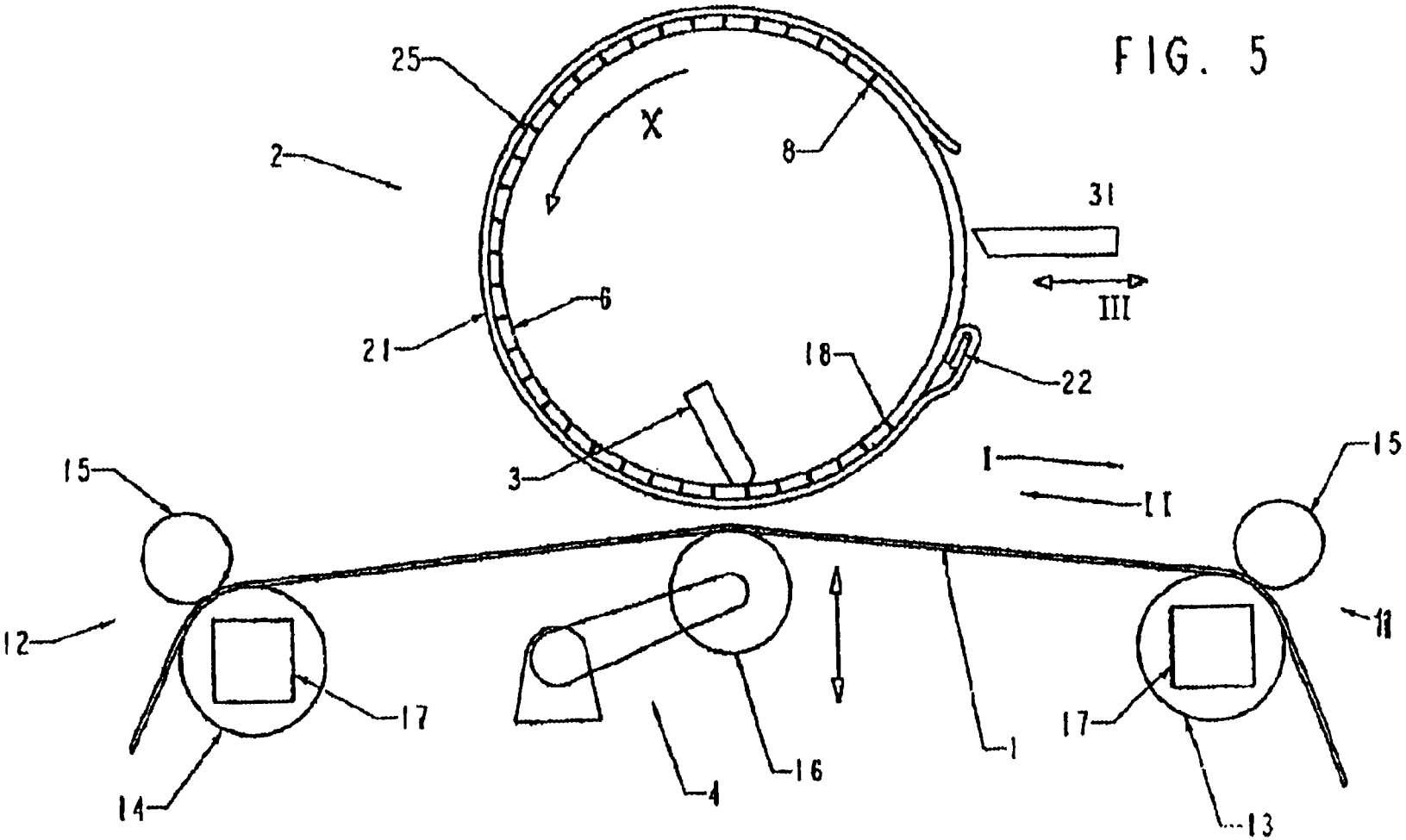
FIG. 5 shows a view of another design of the printer device with a printing stencil that can be changed automatically, and FIGS. 6A/B show systems for changing the stencil automatically.

The device according to FIG. 5 differs from that of FIG. 3A in that the printing stencil 21 can be replaced automatically. In order to replace the printing stencil 21, an element 31 is provided which, with respect to the printing cylinder, is arranged such that it can be moved in the direction of the double arrow III.

Figure 6A:
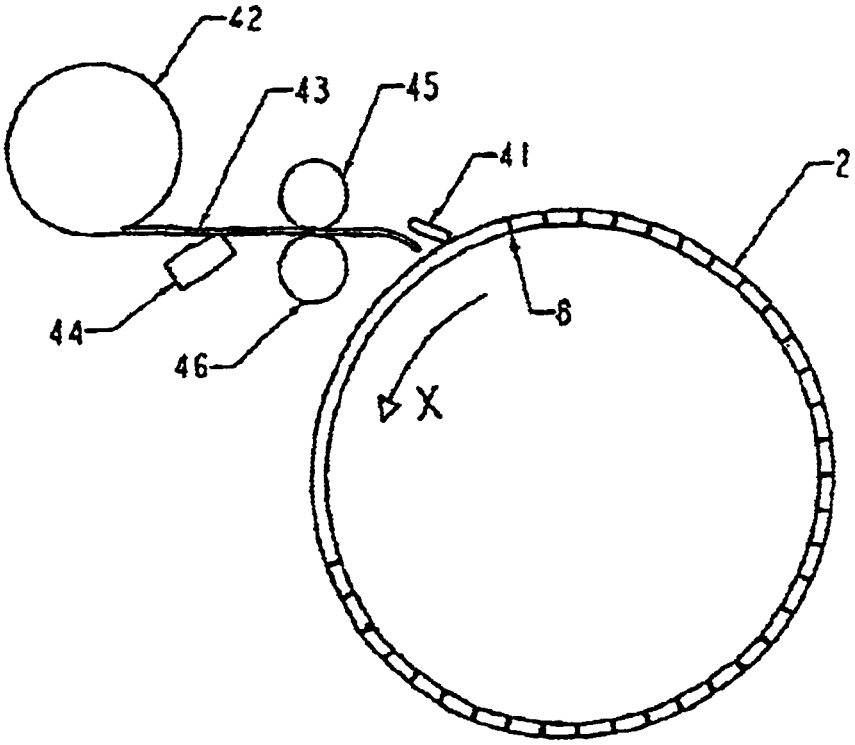
Figure 6B:
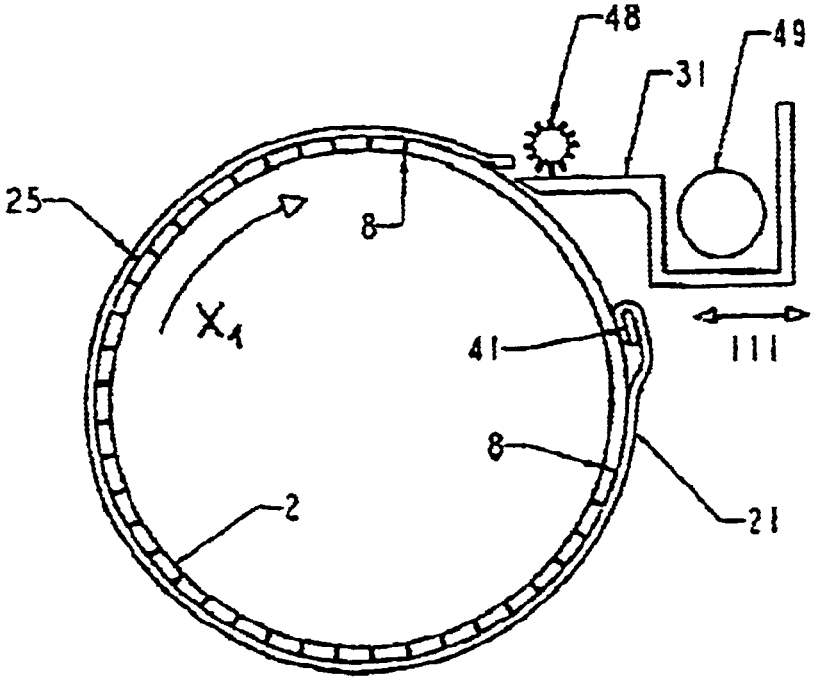

The automatic change will be explained using FIGS. 6A and 6B. FIG. 6A illustrates schematically the system for fitting the printing stencil and FIG. 6B illustrates schematically the system for removing the printing stencil. For this purpose, a clamping element 41 which can be released and closed automatically is provided on the printing cylinder 2.

The fitting system comprises a supply roll 42 of strip material 43 for the stencil, a thermal printhead or a digitally controlled laser device 44 and two conveyor rollers 45, 46. In order to fit a printing stencil 21, the printing cylinder is set in such a way that, with the clamping element 41 open, the free end of the strip material can be inserted underneath the open clamping element. The clamping element 41 is then closed. As a result of the rotation of the printing cylinder in the counterclockwise direction X, the strip material 43 is pulled off the supply roll 42, provided by the printhead 44 with openings 25 for the printing medium and wound onto the printing cylinder. Once the strip length necessary for the printing stencil has been pulled off and the stencil has been provided with openings, the strip material is cut off by means of a cutting device, not illustrated. FIG. 6B shows the printing stencil 21 fitted in this way, the free end of the latter projecting from the printing cylinder in order to make it easier to remove the printing stencil. The printing stencil is lifted off the printing cylinder 2 by an element 31, which is arranged in such a way that it can move in the direction of the arrow III. The element is part of a mechanism which includes a wheel 48 for pulling off the lifted printing stencil 21 and a cylinder 49 for holding the printing stencil. In order to lift the printing stencil, the element 31 is moved in the direction of the printing cylinder in such a way that the element 31 grips the free end of the printing stencil. The printing cylinder is then rotated in the clockwise direction X1. As a result, the printing stencil is lifted off the printing cylinder and the clamping element 41 is opened.

A rotary screen printing method for flat textile structures, in particular textile strips, is disclosed. In this method, at least one image represented as a printing repeat is printed onto the flat structure 1 by means of a continuously rotating printing cylinder 2 having at least one circumferential section in the circumferential surface which is permeable to printing medium. In order to print a printing repeat in the circumferential direction, the flat textile structure 1 is moved to a printing position determined by the printing cylinder, furthermore brought into operative connection with the printing cylinder 2 and, following printing, brought out of operative connection. For this purpose, the flat textile structure 1 is moved forward and back stepwise for each printing repeat.

A device for carrying out the method contains a conveying device 4 with a reversible drive device 11 for setting the flat structure to the printing position by means of stepwise forward and back movement.

Designations
A Time interval
B Time interval
C Time interval
D Time interval
E Time interval
F Time interval
T Time
V Speed
X Direction of rotation of printing cylinder
Y Direction of movement of strip
1 Textile strip
2 Printing cylinder
3 Squeegee
4 Conveying device
6 Wall section
7 Section
11 Pair of rollers
12 Pair of rollers
13 Transport roller
14 Transport roller
15 Pressure roller
16 Pressure roller
21 Printing stencil
22 Firm clamping means
25 Opening
26 Pattern
31 Element for the replacement
32 Inking roll
33 Inking roll
41 Clamping element
42 Supply roll
43 Strip material
44 Printhead
45 Conveyor roller
46 Conveyor roller
48 Wheel
49 Cylinder

What is claimed is:

1. A screen printing method for flat textile structures, in particular textile strips, in which at least one image represented as a pattern repeat is printed on the flat structure by means of a continuously rotating printing cylinder having at least one circumferential section in the circumferential surface that is permeable to a printing medium, characterized in that, in order to print a printing repeat in the circumferential direction, the flat textile structure is moved to a printing position determined by the printing cylinder, brought into operative connection with the printing cylinder and, after printing, is brought out of operative connection, and in that the flat textile structure is moved forward and back stepwise for each pattern repeat.

2. The method as claimed in claim 1, characterized in that the flat textile structure is moved back into the printing position predetermined by the printing cylinder.

3. The method as claimed in claim 1, characterized in that the rearward guidance of the flat textile structure comprises the following steps: stopping the flat textile structure; pulling the flat textile structure back; stopping the rearward movement; accelerating the flat textile structure to the circumferential speed of the printing cylinder; laying the flat textile structure on the printing cylinder when the printing position is reached.

4. The method as claimed in claim 3, characterized in that the flat textile structure is moved beyond the printing position during the rearward movement.

5. The method as claimed in claim 1, characterized in that a printing stencil is used.

6. A device for carrying out the method, as claimed in one of the proceeding claims having a continuously rotating printing cylinder with at least one circumferential section that is permeable to a printing medium, having a device arranged in the printing cylinder for inking the printing cylinder, and having a conveying device for the flat textile structure, characterized in that the printing position is determined by the circumferential section that is permeable to the printing medium, and in that the conveying device has a reversible drive device for setting the flat textile structure to the printing position by moving the flat textile structure backward and forward for each pattern repeat.

7. The device as claimed in claim 6, characterized in that the printing cylinder consists of metal or plastic.

8. The device as claimed in claim 6, characterized in that the device for inking the printing cylinder is a squeegee.

9. The device as claimed in claim 6, characterized in that the device for inking the printing cylinder is an inking unit.

10. The device as claimed in claim 6, characterized in that the conveying device is formed as a roller arrangement.

11. The device as claimed in claim 6, characterized in that at least one printing stencil is arranged on the section of the printing cylinder that is permeable to the printing medium.

12. The device as claimed in claim 11, characterized in that a plurality of printing stencils are arranged beside one another.

13. The device as claimed in claim 11, characterized in that the printing stencil is arranged on the printing cylinder such that it can be replaced manually or automatically.

14. The device as claimed in claim 11, characterized in that the printing stencil is produced online in a digital manner.

15. The device as claimed in claim 11, characterized in that the printing stencil is produced by means of a digitally controlled thermal or laser device.

16. The device as claimed in claim 11, characterized in that the printing stencil consists of plastic.

* * * * *

UNITED STATES PATENT AND TRADEMARK OFFICE

CERTIFICATE OF CORRECTION

PATENT NO. : 6,948,426 B2
DATED : September 27, 2005
INVENTOR(S) : John Rush

It is certified that error appears in the above-identified patent and that said Letters Patent is hereby corrected as shown below:

Title page,
Insert Item -- [30] Foreign Application Priority Data
October 4, 2001 (DE)……..20116246.6 --.

Signed and Sealed this

Thirteenth Day of December, 2005

JON W. DUDAS
*Director of the United States Patent and Trademark Office*